US010994884B2

(12) United States Patent
Voo

(10) Patent No.: US 10,994,884 B2
(45) Date of Patent: May 4, 2021

(54) PORTABLE FILM PACKING APPARATUS

(71) Applicant: Ming Chu Voo, Kota Kinabalu (MY)

(72) Inventor: Ming Chu Voo, Kota Kinabalu (MY)

( * ) Notice: Subject to any disclaimer, the term of this patent is extended or adjusted under 35 U.S.C. 154(b) by 156 days.

(21) Appl. No.: 16/154,951

(22) Filed: Oct. 9, 2018

(65) Prior Publication Data

US 2020/0108967 A1 Apr. 9, 2020

(51) Int. Cl.
*B65B 67/08* (2006.01)
*B65H 16/00* (2006.01)

(52) U.S. Cl.
CPC ..... *B65B 67/085* (2013.01); *B65H 16/005* (2013.01); *B65H 2402/41* (2013.01)

(58) Field of Classification Search
CPC ..... B65B 67/085; B65B 5/00; B65H 16/005; B65H 2402/41
USPC ..... 53/592, 390, 582, 219
See application file for complete search history.

(56) References Cited

U.S. PATENT DOCUMENTS 4,166,589 A * 9/1979 Hoover ..... B65B 67/085 156/577
4,714,211 A * 12/1987 Hwang ..... B65B 67/085 242/423.1
5,779,179 A * 7/1998 Zentmyer ..... B65B 67/085 242/423.2
6,883,298 B2 4/2005 Gooding et al.
6,920,742 B1 * 7/2005 Yu Chen ..... B65B 67/085 156/574
7,228,677 B2 7/2007 Yu Chen
7,437,863 B2 10/2008 Moser et al.
8,317,124 B2 11/2012 Yu Chen
10,059,548 B2 * 8/2018 Chen ..... B65B 59/04
2003/0192291 A1 * 10/2003 Qicang ..... B65B 67/08 53/588
2003/0208994 A1 * 11/2003 Gooding ..... B65B 67/085 53/557
2007/0151208 A1 * 7/2007 Huang ..... B65B 67/085 53/390
2011/0233321 A1 * 9/2011 Yu Chen ..... B65H 16/005 242/588.2
2018/0065827 A1 * 3/2018 Nelson ..... B65B 67/085
2020/0039675 A1 * 2/2020 Wolf ..... B65H 35/002
2020/0108967 A1 * 4/2020 Voo ..... B65B 67/085

* cited by examiner

*Primary Examiner* — Hemant Desai
*Assistant Examiner* — Christopher Robin Kim
(74) *Attorney, Agent, or Firm* — Goldilocks Zone IP Law

(57) ABSTRACT

A portable film packing apparatus includes a main body including a holding-and-drawing rod at the middle portion of the main body, a first combining rod is at a one end, and a second combining rod is disposed at the other end of the main body; a first roller unit having a first roller having its opposite ends respectively fixed with a pair of a first roller unit gears; and a second roller unit having second roller having its opposite ends respectively fixed with a pair of a second roller unit gears, wherein the first roller unit and the second roller unit are provided with the pair of the first roller unit gears and the pair of the second roller unit gears to mesh with each other, wherein a diameter of the first roller is smaller than a diameter of the second roller.

13 Claims, 16 Drawing Sheets

PORTABLE FILM PACKING APPARATUS

BACKGROUND OF THE INVENTION

1. Field of the Invention

This invention relates to a portable film packing apparatus, particularly to enable user to quickly release a roll of film with one hand. This invention relates to membrane reel, a roll of film, loading and unloading apparatus, particularly assembled at one side of a main body of a portable film packing apparatus and able to mount or load the membrane reel to the portable film packing apparatus for controlling the membrane reel to release film with proper tightness.

Furthermore, there is a need for a film packing apparatus that allows convenient loading membrane reel and a roll of wrapping film into the film packing apparatus.

2. Description of the Prior Art

U.S. Pat. No. 6,920,742, assigned to Hsie-Man Yu Chen, does not have a membrane release unit, thus, it is not easy to mount or unmount the membrane reel from the film packing apparatus.

That is, a user quite inconvenient to mount or unmount a membrane reel with one hand from the film packing apparatus.

SUMMARY OF THE INVENTION

The objective of the invention is to offer a portable membrane packing apparatus provided with a quick and easy release mechanism to mount the membrane onto the portable membrane packing apparatus. The portable membrane packing apparatus includes a second reel holding unit, spring compression unit and a membrane release unit that could be pulled toward a second combining rod for quick and easy mounting and unmounting of the membrane unit. The portable membrane packing apparatus also includes a first and a second roller with different diameters to promote stretching of the membrane unit by increasing membrane tension. Furthermore the portable membrane packing apparatus includes a standing unit that allows the portable membrane packing apparatus to stand with the aid of a second combing rod.

According to an aspect of the present invention, a portable film packing apparatus, includes: a main body including a holding-and-drawing rod at a middle portion of the portable film packing main body, a first combining rod is at one end, and a second combining rod disposed at the other end of the portable film packing main body; a first reel holding unit rotatably attached to the first combining rod; a boss attached to the second combining rod, an elastic body disposed in the bore of the boss; the membrane reel release unit movably attached to the boss; an elastic body compression unit configured to compress the elastic body; a second reel holding unit attached to the elastic body compression unit and faced with the first reel holding unit, and wherein the first reel holding unit and the second reel holding unit maintain a first predetermined distance while holding a membrane reel unit therebetween, wherein the first reel holding unit and the second reel holding unit becomes a predetermined second distance therebetween while holding the membrane release unit by a user to release the membrane reel, and wherein the first predetermined distance is shorter than the second predetermined distance.

Another aspect of present invention, the portable film packing apparatus includes the boss, which includes a pair of membrane release unit limiting elongate grooves formed symmetrically on the boss, respectively, to receive the membrane release unit therethrough.

Another aspect of present invention, the portable film packing apparatus may include the elastic compression unit includes two ends, one end is a closed end formed with a small-diameter bolt head to be inserted through the reel connecting unit hole of the second reel holding unit and screwed with a nut to fix the elastic compression unit with the second reel holding unit and the other end bored with a hollow to receive the elastic body.

An aspect of present invention, the portable film packing may include the elastic compression unit further including its wall axially cut with two symmetrical membrane release unit insert holes for fixing the membrane release unit inserted therethrough.

An aspect of present invention, the portable film packing apparatus may include the elastic body, which is a spring.

An aspect of present invention, the portable film packing apparatus may include the first reel holding unit and the second reel holding unit are rotatably fastened by a bearing and a nut, respectively.

An aspect of present invention, the portable film packing apparatus may include the first reel holding unit and the second reel holding are rotatably fastened by a thrust bearing, a washer and a nut, respectively.

An aspect of present invention, the portable film packing apparatus may include the membrane release unit is in a shape of a bar.

An aspect of present invention, a portable film packing apparatus may include a main body including a holding-and-drawing rod at the middle portion of the main body, a first combining rod is at a one end, and a second combining rod disposed at the other end of the main body; a first roller unit having a first roller having its opposite ends respectively fixed with a pair of a first roller unit gears; and a second roller unit having second roller having its opposite ends respectively fixed with a pair of a second roller unit gears, wherein the first roller unit and the second roller unit are provided with the pair of the first roller unit gears and the pair of the second roller unit gears to mesh with each other, wherein a diameter of the first roller is smaller than a diameter of the second roller thereby the first roller unit and the second roller unit are driven to rotate.

An aspect of present invention, the portable packing apparatus may include the first roller unit disposed at a first predetermined distance from the holding-and-drawing rod and the second roller disposed at the second predetermined distance from the hold-and-drawing rod, and wherein the first predetermined distance is longer than the second predetermined distance.

An aspect of present invention, the portable film packing apparatus may include a right roller fixing plate attached to a predetermined position of the first combining rod; and a right roller fixing plate attached to the second combining rod, wherein the first roller unit further includes a first roller shaft and the second roller unit further includes a second roller shaft, and wherein the first roller shaft and the second roller shaft are inserted into the first roller and the second roller, respectively, and attached to the left and the right roller fixing plates.

An aspect of the present invention, a portable film packing apparatus may include a u-shape main body including a holding-and-drawing rod at the middle portion of the main body and a combining rod unit having a first combining rod formed at a one end the holding-and-drawing rod and a second combining rod formed at the other end of the holding-and-drawing rod; a first reel holding unit rotatably formed at a middle of the first combining rod; a second reel holding unit formed at a middle of the second combining rod and faced with the first reel holding unit; and a roller unit formed at an end of the combining rod unit, wherein the roller unit having a first roller unit having a first roller having its opposite ends respectively fixed with a pair of a first roller unit gears and a second roller unit having a second roller having its opposite ends respectively fixed with a pair of a second roller unit gears, wherein the first roller unit and the second roller unit are provided with the pair of the first roller unit gears and the pair of the second roller unit gears to mesh with each other, wherein an angle less than an acute is formed between the combing rod unit and the roller unit.

An aspect of present invention, the portable packing apparatus may include a standing unit configured to stand the portable packing apparatus, wherein the stand unit is attached to the first combining rod.

An aspect of present invention, the portable packing apparatus may include the standing unit further includes a portion of the first combining rod.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF DRAWINGS

The above and other objects, features and advantages of certain exemplary embodiments of the present invention will be more apparent from the following detailed description taken in conjunction with the accompanying drawings, in which.

DETAILED DESCRIPTION OF THE PREFERRED EMBODIMENT

Figure 1:
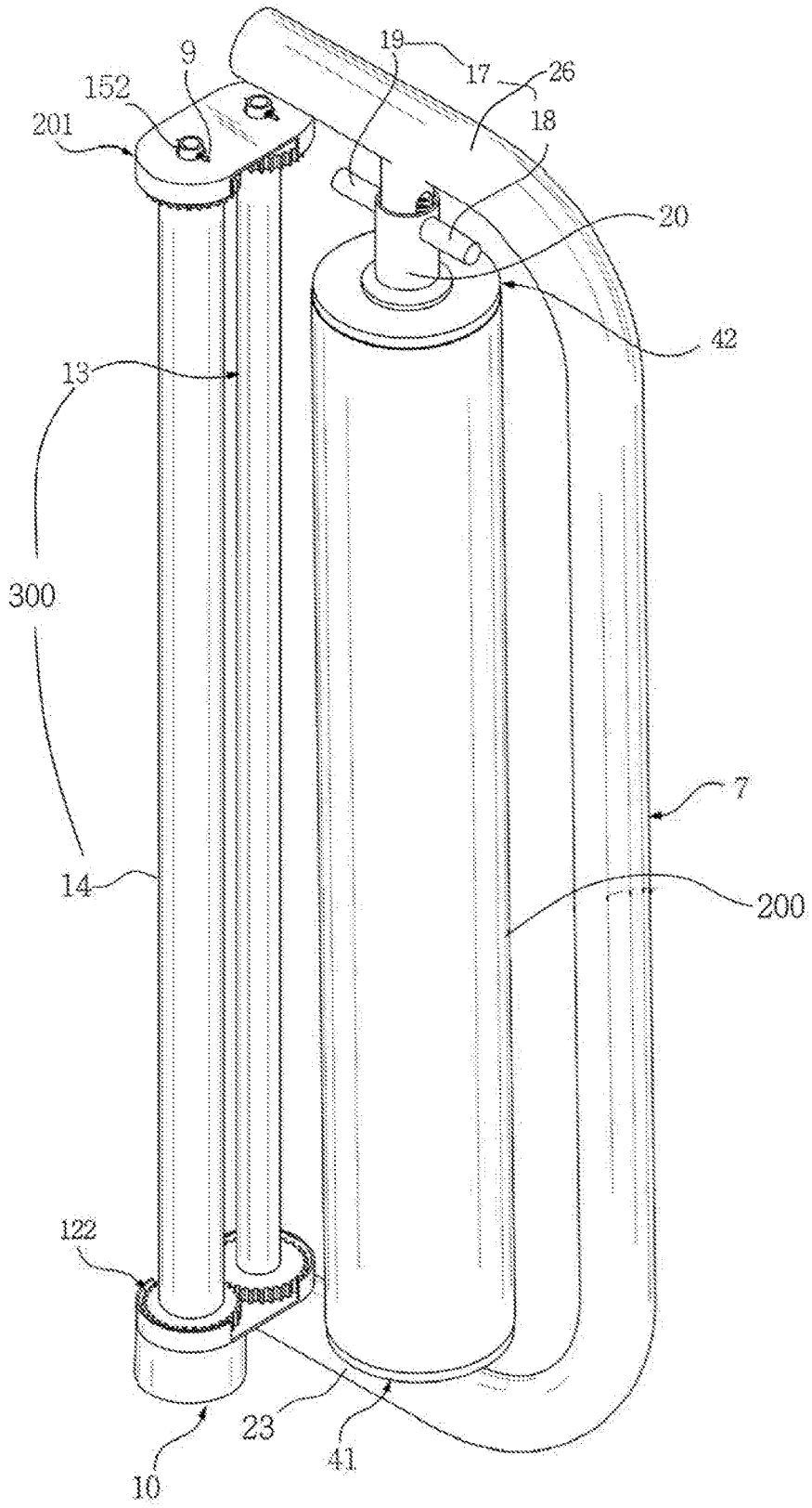
FIG. 1 illustrates a perspective view of a portable film packing apparatus in the present invention.

Hereinafter, exemplary embodiments of the present invention will be described with reference to the accompanying drawings. In the following description, a detailed description of known functions and configurations which may obscure the subject matter of the present invention will be omitted.

The matters defined in the description such as a detailed construction and elements are provided to assist in a comprehensive understanding of exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

A portable film packing apparatus as shown in FIGS. 1-8, includes an U-shaped portable film packing main body 100 and a membrane release unit 17.

The portable film packing main body 100 may include a holding-and-drawing rod 7 at the middle portion of the portable film packing main body 100, a first combining rod 23 at an one end, and a second combining rod 26 disposed at the other end of the portable film packing main body 100.

Each end of the first combining rod 23 and the second combining rod 26 may have holes 24 to be clogged by a plug (not shown), respectively.

A first combining rod 23 may be bored with an insert hole 25 in the inner wall of an intermediate portion. In addition, the two combining rods 23 and 26 may have their tube end holes 24 respectively clogged with a column-shaped positioning block (not shown) having a threaded hole (not shown) in the circumferential wall and able to be turned around to let its threaded hole aligned to the their tube end holes of the combining rod 23 and 26. However, it is understood that it is not limited thereto.

For example, it may be no hole required to the end of the rods 23, 26 according to an aspect of the present invention.

Figure 3:
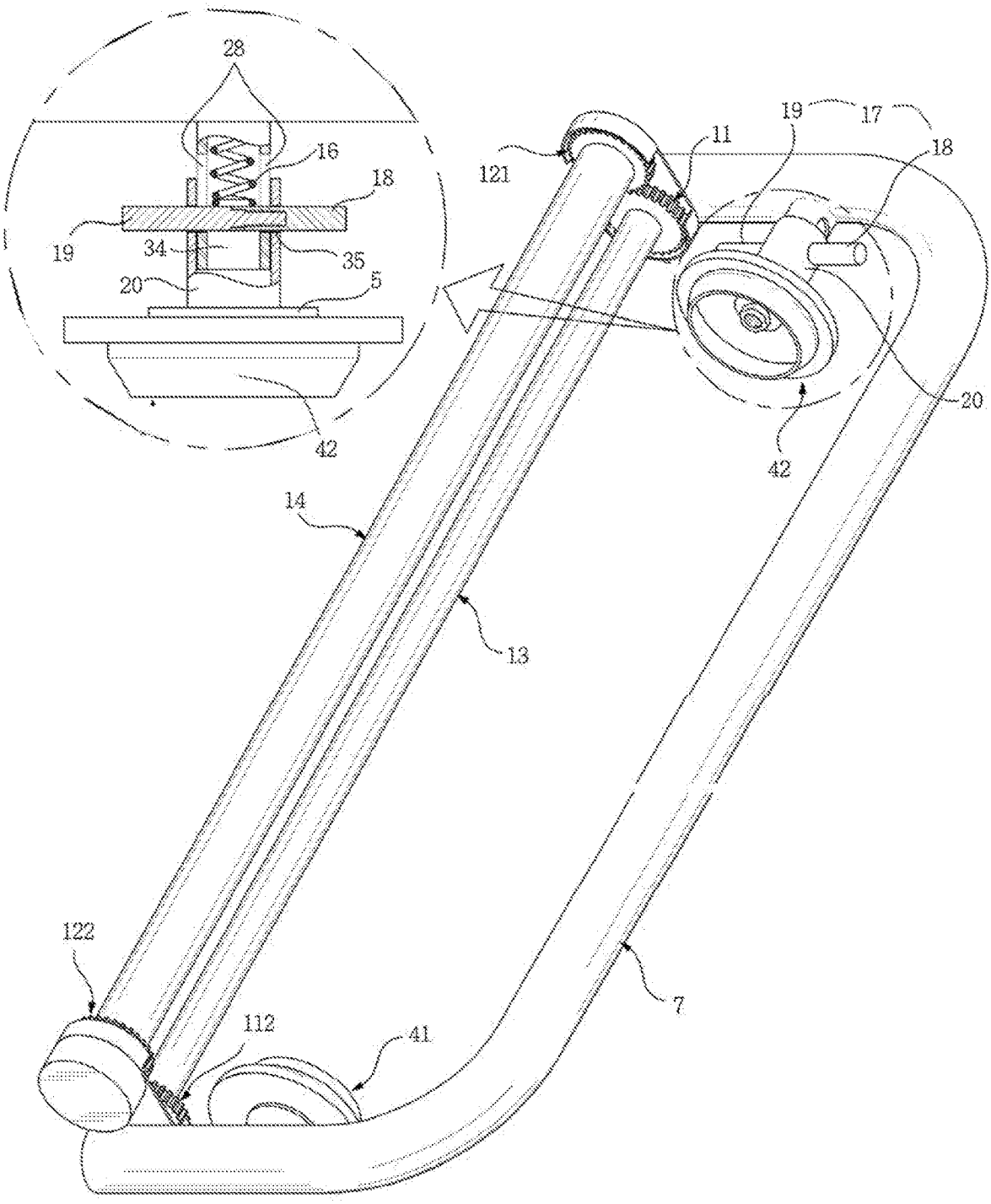
FIG. 3 illustrates an exploded view of the left side of the portable film packing apparatus according to an aspect of the present invention.

An embodiment of a portable film packing apparatus of the present invention, as shown in FIGS. 1 and 3, may include a first reel holding unit 41 and a second reel holding unit 42, a holding-and-drawing rod 7, a left roller fixing unit or a second roller fixing unit 201, a right roller fixing plate or a first roller fixing plate 202, a first roller unit 13, a second roller unit 14, a membrane release unit 17, and a spring compression unit 20.

The membrane release unit 17 may include a first part 18 of the membrane release unit 17 and a second part 19 of the membrane release unit 17. It is understood that a membrane release unit 17 may be formed in a single body.

A first combining rod 23, which may have a tread hole 25 to fix a first reel holding unit 41 to the first combining rod 23 using a shaft bolt 6, which is screwed into the tread hole 25 of the first combining rod 23. The shaft bolt 6 may have two ends, one end is inserted into the tread hole 25 and the other end is screwed by the nut 1 to securely fix the first reel holding unit 41 to the first combining rod 23.

According to an aspect of the present invention, in order to fix a first reel holding unit 41 to the first combining rod 23, an annual base 5, a thrust bearing 3, and a first washer 2, are orderly inserted into the shaft bolt 6, and then screwed by the nut 1. Thus, the first reel holding unit 41 may be rotatably fixed to the first combining rod 23. It is understood that the first washer 2 can help the nut 1 to securely fasten the thrust bearing 3 and the first reel holding unit 41 into the first combining rod 23 without loosened.

A second combining rod 26, which may have a boss 27 protruded toward to the insert hole 25 of the first combining rod 23.

The boss 27 has a bore 29 to receive a spring 16. In addition, the boss 27 has a pair of elongate grooves 28 formed symmetrically on a top and a bottom of the boss 27, respectively, to receive the membrane release unit 17 therethrough.

Figure 2:
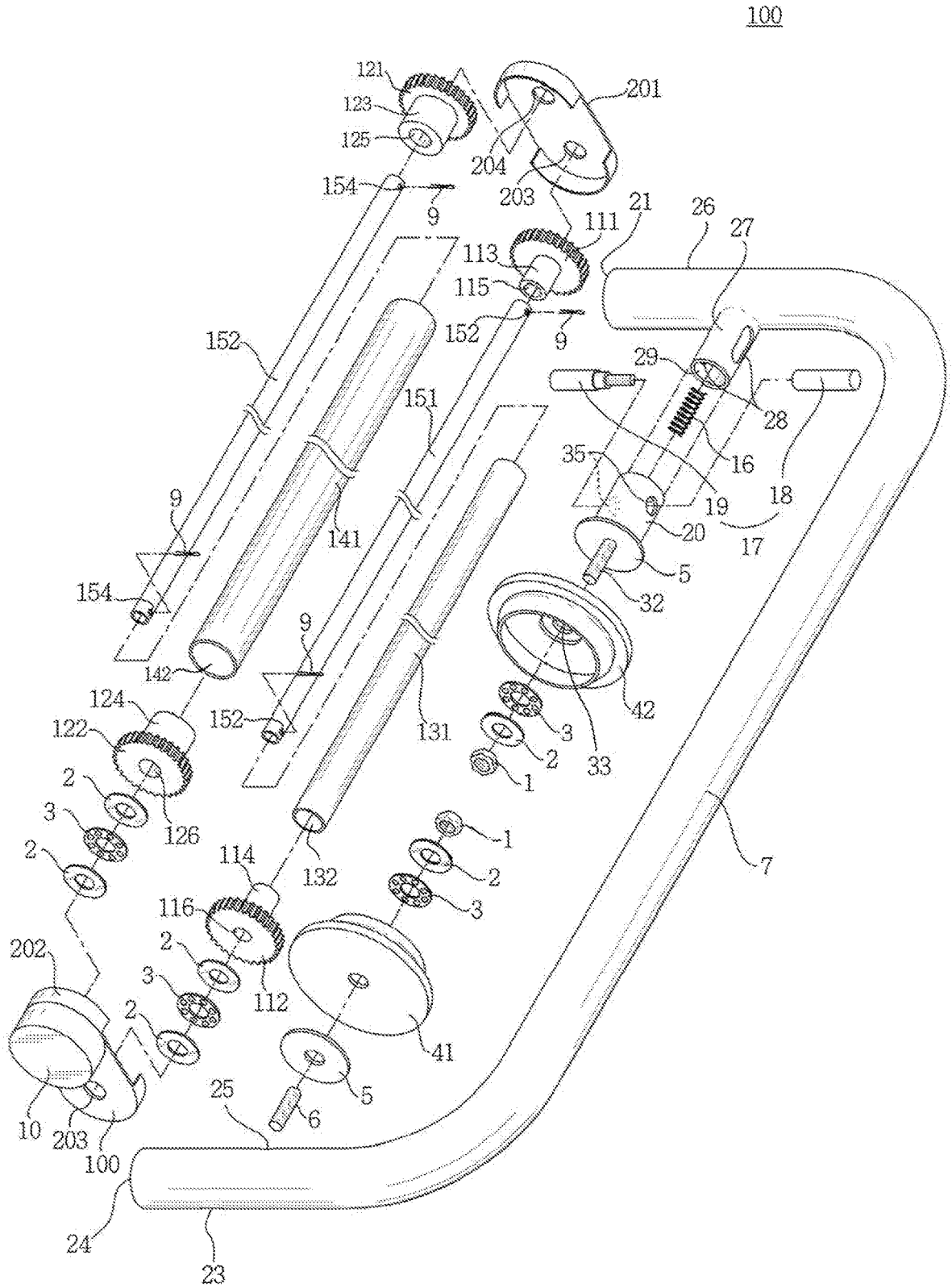
FIG. 2 illustrates an exploded perspective view of the portable film packing apparatus according to an aspect of the present invention.

As shown in FIGS. 1-3, the other end of the bore 29 is blocked by a wall of the second combining rod 26 to limit a movement of the spring 16. However, it is not limited thereto. As an example, the spring can be replaced with any elastic body, which has an elastic force according to an aspect of the present invention.

The spring compression unit 20 has two ends, one end is a closed end formed with a small-diameter bolt head 32 to be inserted through a reel holding unit hole 33 of the second reel holding unit 42 and screwed with a nut 1 to fix the spring compression unit 20 with the second reel holding unit 42. The spring compression unit 20 has the other end bored with a hollow 34 to receive the spring 16, and further has its wall axially cut with two symmetrical membrane release unit insert holes 35 for fixing the membrane release unit 17 inserted therethrough.

An annual base 5, the second reel holding unit 42, a thrust bearing 3, and a first washer 2 are in orderly inserted into the small-diameter bolt head 32, and then screwed by the nut 1 to securely fix the second reel holding unit 42 into the spring compression unit 20. Thus, the second reel holding unit 42 may be rotatably fixed to the spring compression unit 20.

As shown in FIGS. 1 and 2, the first part of the membrane release unit 17 may include a thread hole, and the second part of the membrane release unit 18 may include one end formed with male threads 181 and a middle portion of the second part which has smaller diameter than the diameter of the first part of the membrane release unit 17 to fit with the tread hole of the first part of the membrane release unit 17.

However, many different shapes of the membrane release unit can be used as long as the first part of the membrane reel release unit and the second part of the membrane release unit can be securely combined to each other. Further a length of the membrane reel release unit may be different from shown in FIGS. 4-5 as long as it can be easily held by one hand of a user.

The membrane reel release unit may be any shape if easy to grip by one hand according to an aspect of the present invention.

It is understood that the membrane reel release unit and the spring compression unit may be formed as a single body.

As shown in FIGS. 1-3, and 5, the spring 16 is inserted into between the bore 29 of the boss 27 and the hollow 34 of the spring compression unit 20. An outer circumference of the boss 27 is inserted into an inner circumference of spring compression unit 20 after the spring 16 is inserted into the bore 29 of the boss 27 and the hollow 34 of the spring compression unit 20, thereby the pair of elongate grooves 28 and the membrane release unit insert hole 35 are vertically aligned each other.

The pair of elongate grooves 28 and the membrane release unit insert holes 35 are vertically aligned to insert the first part 18 of the membrane release unit 17 and the second part 19 of the membrane release unit 17, respectively, to combine each other to form the membrane release unit 17.

The spring 16 is being compressed in between by the wall of the first combining rod 23 and the membrane release unit 17. Thus, the spring compression unit 20 is capable of pushing the second reel holding unit 42 to move toward to the first reel holding unit 41 to hold the membrane reel 200 by its resilience.

Referring to FIGS. 2-3, 5, and 9-13, the first reel holding unit 41 is rotatably fixed to at a predetermined position of the combined rod 23 while the second reel holding unit 42 is moved back and forth toward the second combining rod 26 by holding the membrane release unit 17 with only one hand to move along with the membrane release unit limited by the pair of elongate grooves 28 to release the membrane reel 200 from the portable film packing apparatus 100, according to an aspect of the present invention.

FIGS. 10-13 illustrate how to mount the membrane reel 200 on to the portable film packing apparatus 100.

Figure 10:
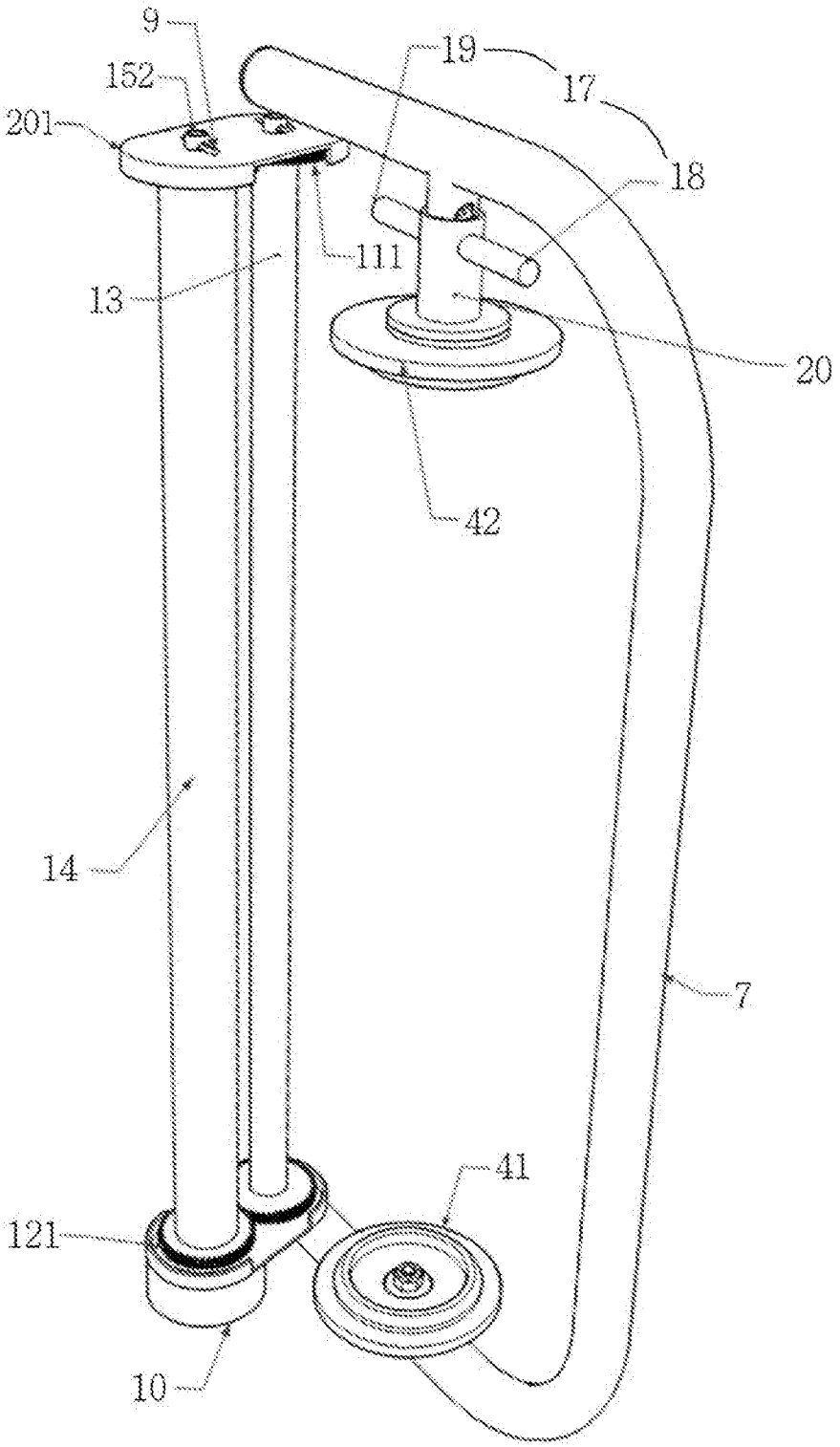
FIG. 10 illustrates a stand-up position view of the portable film packing apparatus in the present invention when membrane reel unit is not mounted according to an aspect of the present invention.

As shown in FIG. 10, the user holds the first combining rod 26 and the membrane release unit 17 to with one hand or two hands to pull the spring compression unit 20 towards the first combining rod 26.

Figure 11:
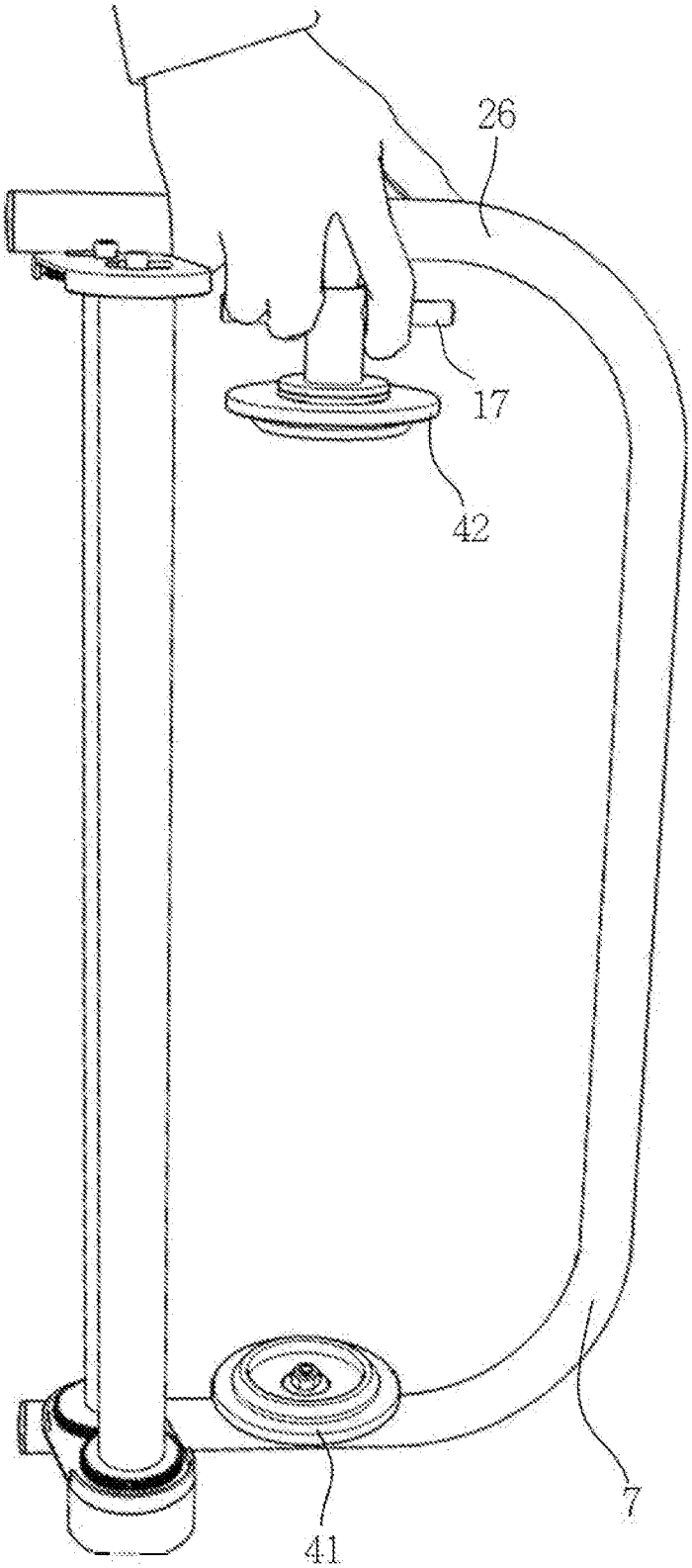
FIGS. 11-14 illustrate how to mount the membrane reel 200 on to the portable film packing apparatus according to an aspect of the present invention.
Figure 12:
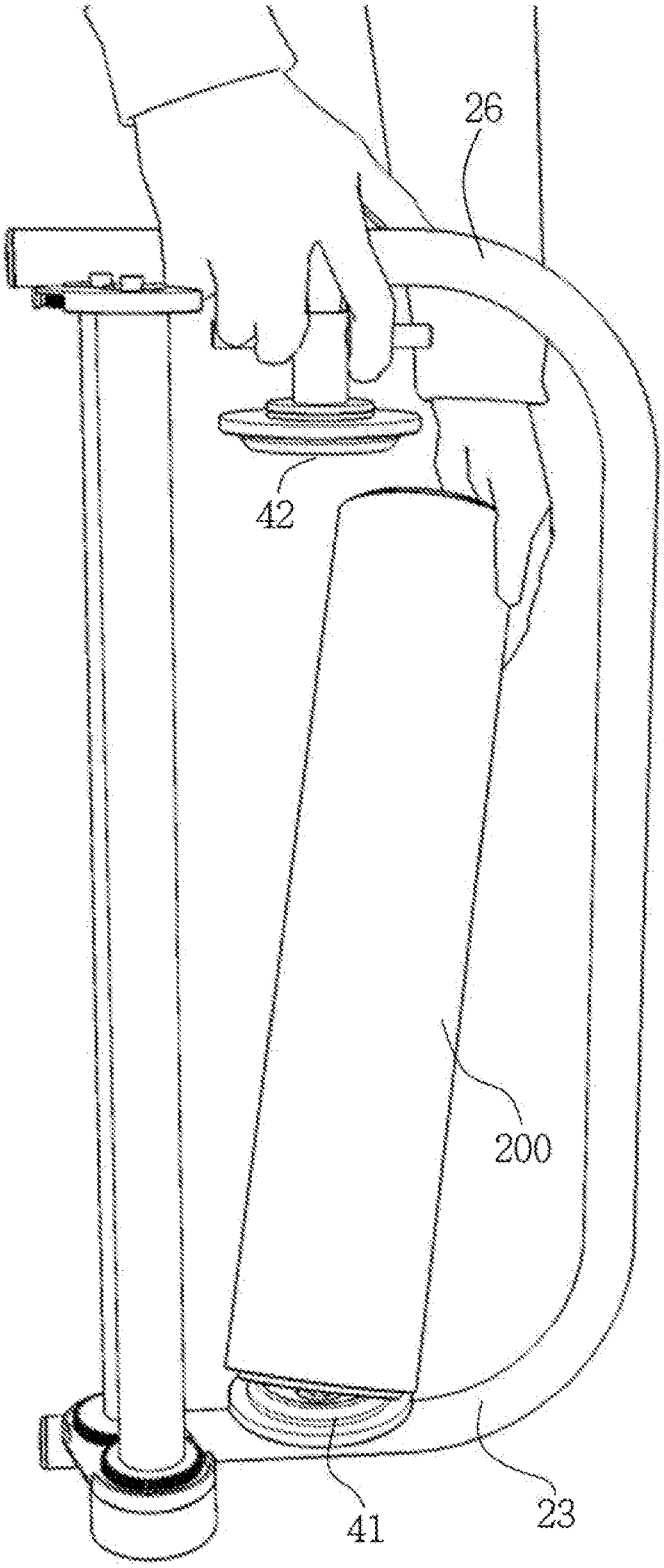

As shown in FIGS. 11-12, while the spring compression unit 20 is pulled towards the first combining rod 26, the membrane reel 200 is mounted on the first reel holding unit 41. The spring compression unit 20 is pulled towards the first combining rod 26 to create enough space for the membrane reel 200 to be mounted on the first reel holding unit 41 and the portable film packing apparatus 100.

Figure 13:
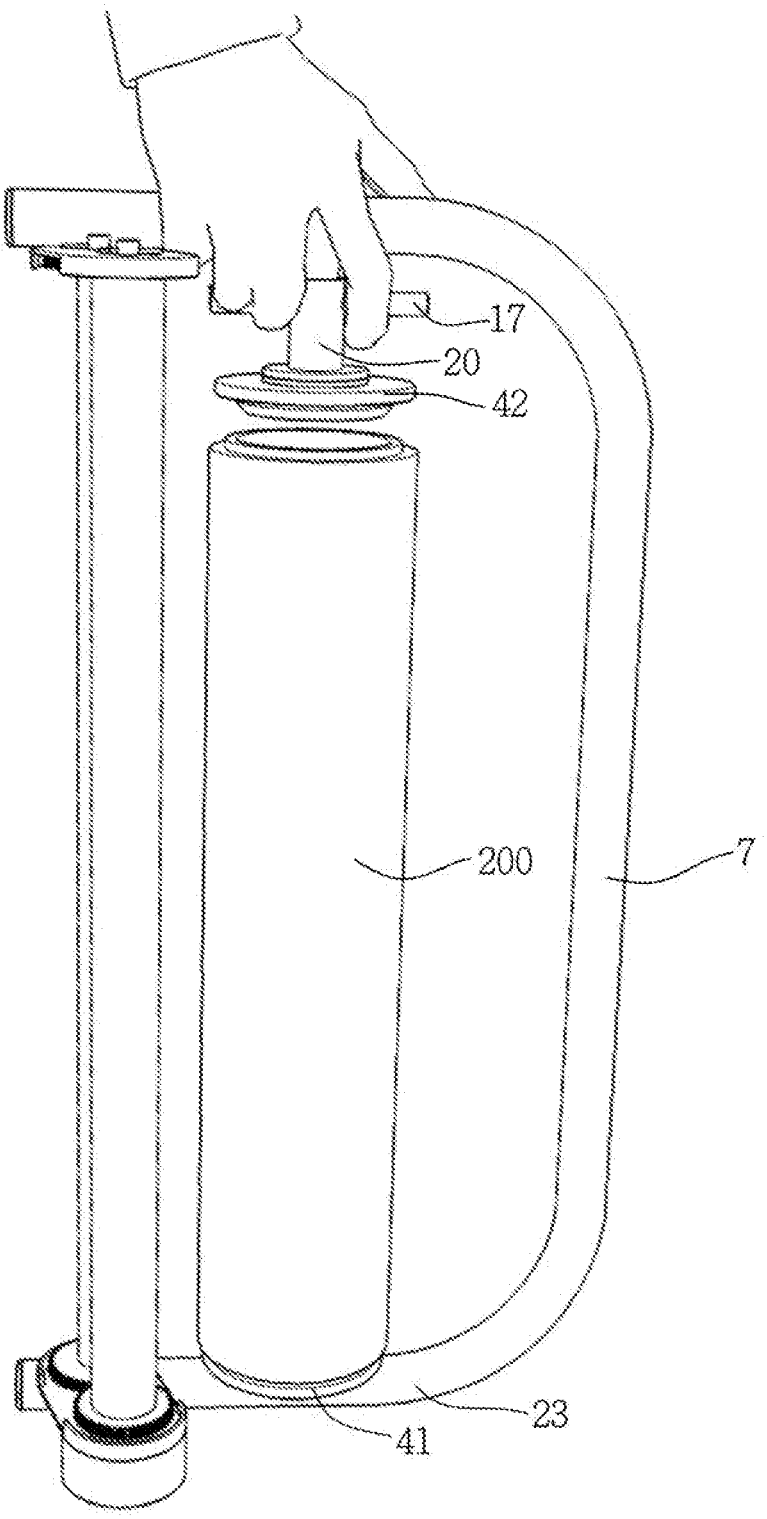
Figure 14:
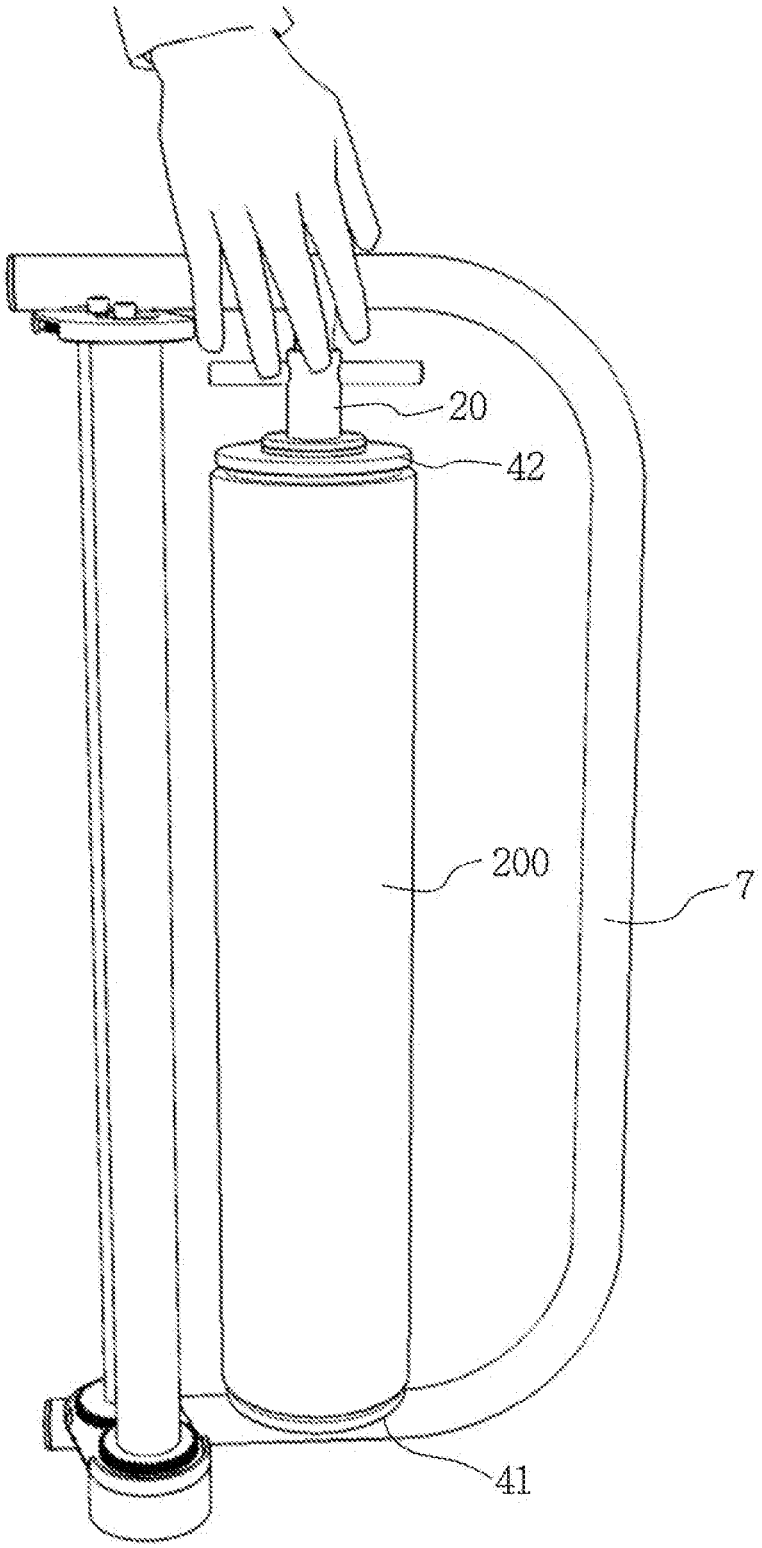
Figure 15:
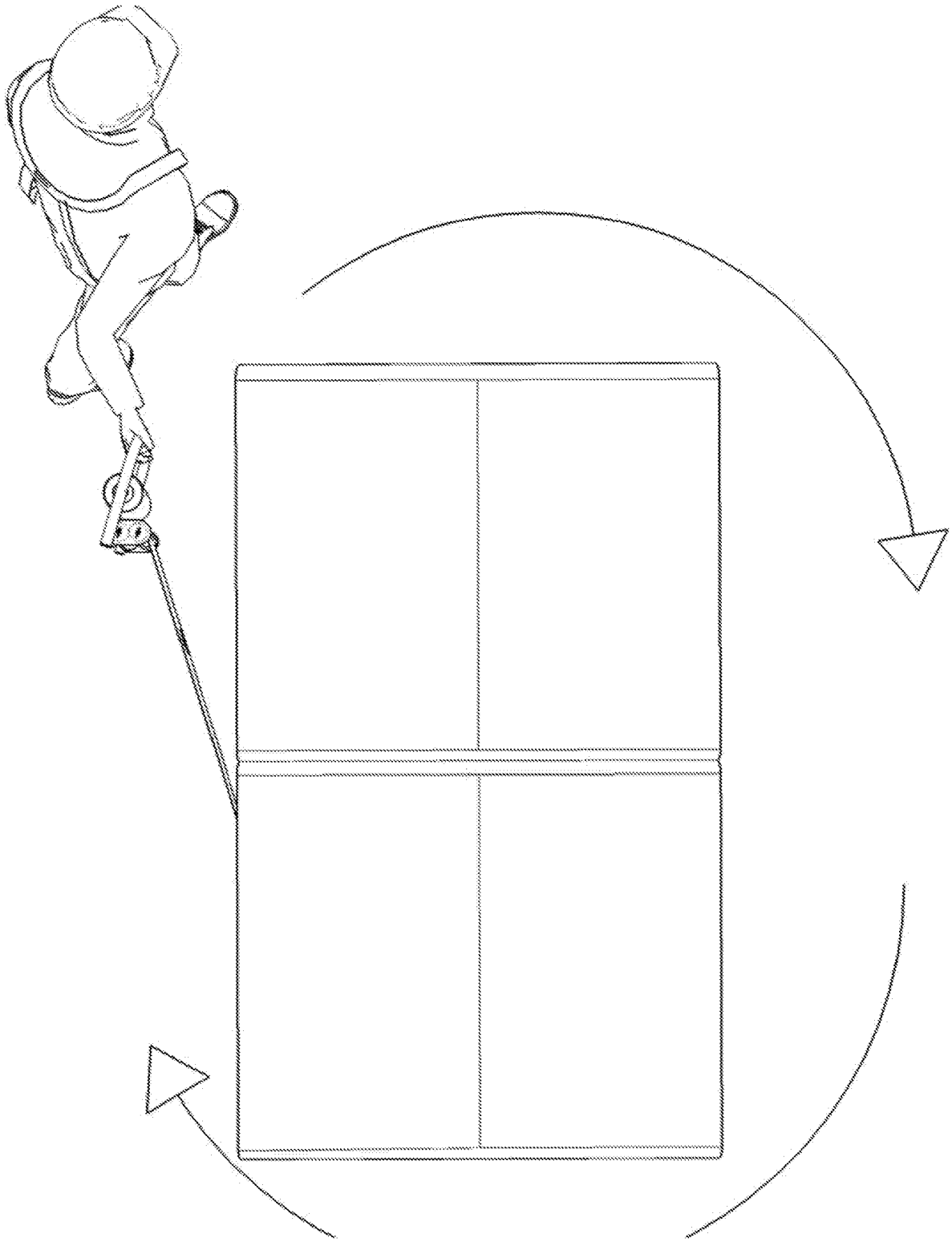
FIG. 15 illustrate top view of the portable film packing apparatus in a packing condition demonstrating wrapping a loading plank and the articles piled thereon according to an aspect of the present invention.
Figure 16:
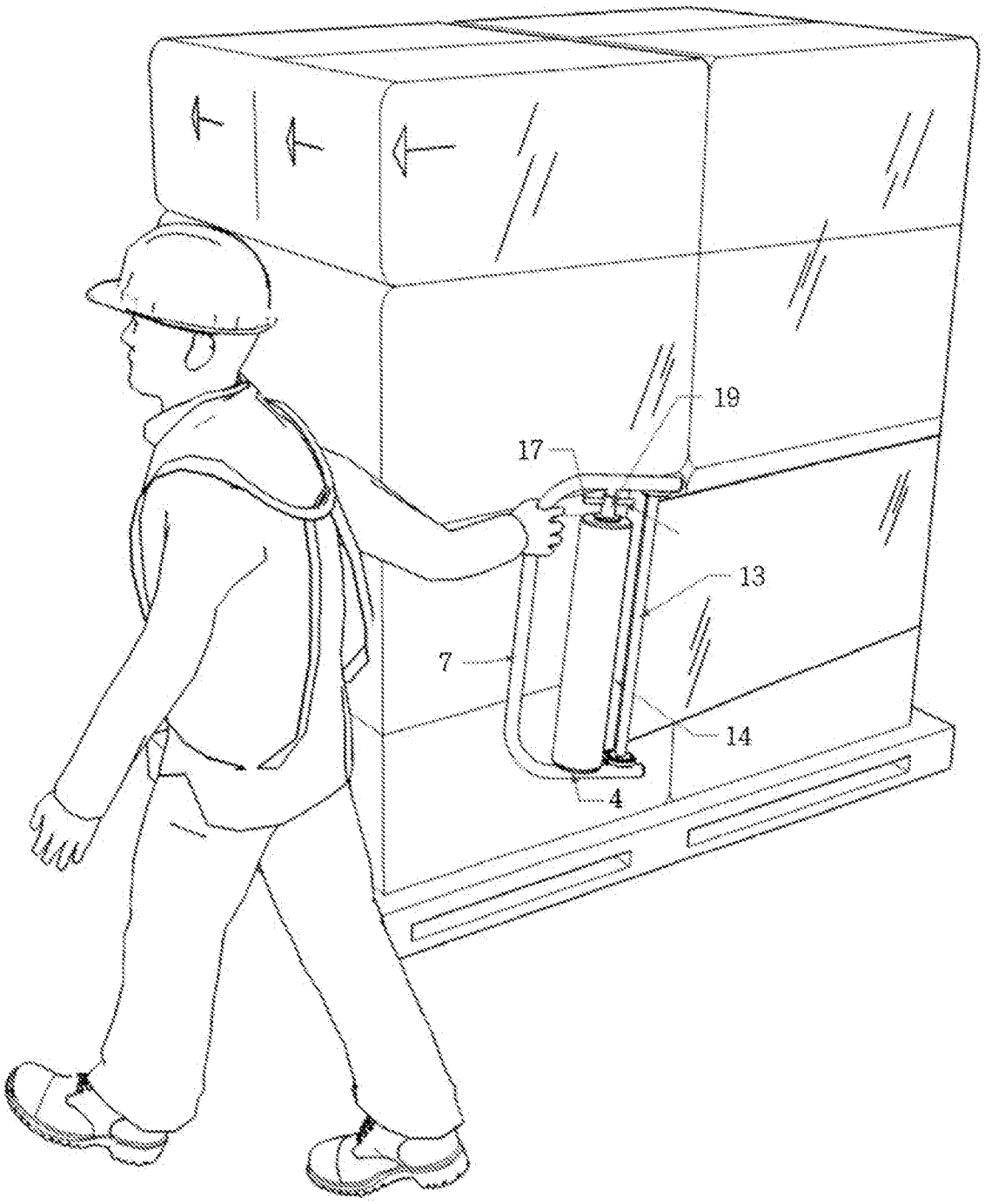
FIG. 16 illustrates side view of the portable film packing apparatus in a packing condition carrying out packing around a loading plank and the articles piled thereon according to an aspect of the present invention.

As shown in FIG. 13, when the membrane reel 200 is mounted on the first reel holding unit 41, the user can release the spring compression unit 20 to its original position to clasp the second reel holding unit 42 on to the membrane reel 200 with the first reel holding unit 41.

Referring to FIGS. 1-2, and 4-7, the portable membrane packing apparatus 100 may further include a pair of gear fixing plates, a left roller fixing plate 201, a right roller fixing plate 202, to fix the first roller unit 13 and the second roller unit 14 to the gears 111, 112, 121, and 122 to the first combining rod 23 and second combining rod 26, respectively, according to an aspect of the present invention.

The first roller unit 13 may include a first roller 131 having its opposite ends respectively fixed with the pair of driven gears 111 and 112.

The pair of roller fixing plates 201 and 202 may be attached to predetermined positions of the first combining rod 23 and the second combining rod 26, respectively, by a welding or riveting method. However, many different ways of attaching methods may be applied to securely fasten the pair of roller fixing plates 201, 202 into the first combining rod 23 and the second combining rod 26. Thus, it is not limited thereto.

A first roller unit 13 may further include the first roller 131 and a first roller shaft 151.

The first roller shaft 151 may further include a pair of holes 152 at each near end of the first roller shaft 151. Instead of a pair holes 152, it is also understood that the first roller shaft 151 may further include a pair of male treads at each end of the first roller shaft 151 (not shown).

The first roller 131 and the two driving gears 111 and 112 are bored with through holes 132, 115 and 126 in the center thereof, respectively, for a first roller shaft 151 to be inserted therethrough.

Both output shafts 113 and 114 and the pairs of the gears 111 and 112 are engaged with two opposite ends of the first roller 131, respectively, to rotate the first roller 131.

According to an aspect of the present invention, the portable film packing apparatus may further include a pair of roller fixing plates, which are a left roller fixing plate 201 and a right roller fixing plate 202, to securely fix the first roller unit 13 and the second roller unit 14 to the first combining rod 23 and second combining rod 26, respectively. The left roller fixing plate 201 and the right roller fixing plate 202 may have two pairs of holes 203 and 204 for the first roller shaft 151 and the second roller shaft 152 to be inserted therethrough, respectively.

A first roller shaft 151 may be inserted into the hole 203 of the left roller fixing plate 201, the left first gear 111, the first roller 131, the first right gear 112, a thrust bearing 3, and the right roller fixing plate 202 from left to right. And then the first roller shaft 151 is fixed to the left roller fixing plate 201 and the right roller fixing plate 202 by the pair of fixing pins 9 inserted into the pair of holes 152 formed on the both opposite end of the first roller shaft 151, respectively. It is also understood that a pair of washers 2 are inserted into both side of the thrust bearing 3 or a washer may be inserted between the first right gear 112 and a thrust bearing 3.

According to an aspect of the present invention, it is also understood that the first roller shaft 151 may be fixed to the left roller fixing plate 201 and the right roller fixing plate 202 by the pair of nuts (not shown), if the first roller shaft includes a pair of male treads are formed at each end of the first roller shaft 151 (not shown) instead of the pair of holes 152. However, it is not limited thereto.

A second roller unit 14 may further include a second roller 141 and a second roller shaft 152.

The second roller shaft 152 may further include a pair of the second roller shaft holes 154 formed on at each near end of the second roller shaft 152. Instead of the pair of second roller shaft holes 154, it is also understood that the second roller shaft 152 may further include a pair of male treads at each end of the second roller shaft 152 (not shown).

The second roller 141 and the two second gears 121, 122 are bored with through shaft holes 125, 142, 126 in the center thereof, respectively, for the second roller shaft 152 to be inserted therethrough.

Both output shafts of the pairs of the second gears 123, 124 are engaged with two opposite ends of the second roller 141, respectively, to rotate the second roller 141.

A second roller shaft 152 may be inserted into the hole 204 of the left roller fixing plate 201, the left second gear 121, the second roller 141, the second right gear 122, a thrust bearing 3, and the right roller fixing plate 202, from left to right. And then the second roller shaft 152 is fixed to the left roller fixing plate 201 and the right roller fixing plate 202 by the pair of fixing pins 9 inserted into the pair of holes 154 formed on the both opposite end of the second roller shaft 152, respectively.

It is also understood that the second roller shaft 152 is fixed to the left roller fixing plate 201 and the right roller fixing plate 202 by the pair of nuts (not shown) if the second roller shaft 152 includes a pair of male treads are formed at each end of the second roller shaft 152 (not shown) instead of the pair of holes 154 according to an aspect of the present invention. However, it is not limited thereto.

It is also understood that a pair of washers 2 are inserted into both side of the thrust bearing 3 or only one washer may be inserted between the first right gear 112 and the thrust bearing 3.

According to an aspect of the present invention, a second roller shaft 152 may be inserted into the hole 204 of the left roller fixing plate 201, a thrust bearing 3 (not shown), left second gear 121, the second roller 141, the second right gear 122, a thrust bearing 3, and the right roller fixing plate 202, from left to right.

According to an aspect of the present invention, symmetrically, washers 2 and thrust bearing 3 may be installed on a left side of the first gear 111 and the second gear 121.

Referring back to FIGS. 1 and 3, the film packing apparatus 100 further includes a roller unit 300 which is disposed between the first combining rod 23 and second combining rod 26. The roller unit 300 may include a first roller unit 13 and a second roller unit 14. The first roller unit 13 may include the first roller 131 and a second roller unit 14 may include the second roller 141. The first roller 131 and the second roller 141 are provided with the first and the second pair of gears 111, 112, 121, 122 to mesh with each other, so that the first roller unit 13 and the second roller unit 14 are driven to rotate.

Figure 4:
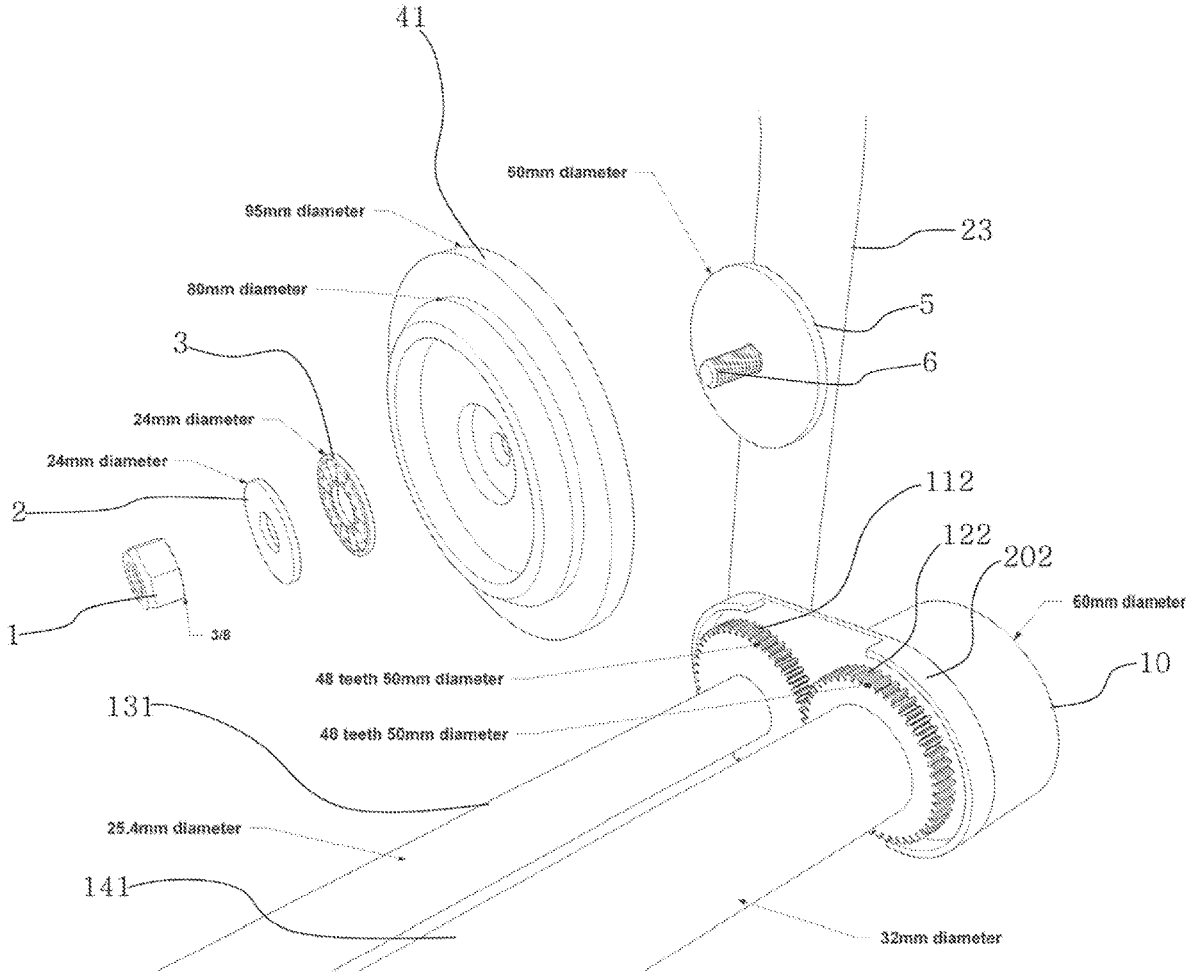
FIG. 4 illustrates an exploded view of the right side of the portable film packing apparatus according to an aspect of the present invention.
Figure 5:
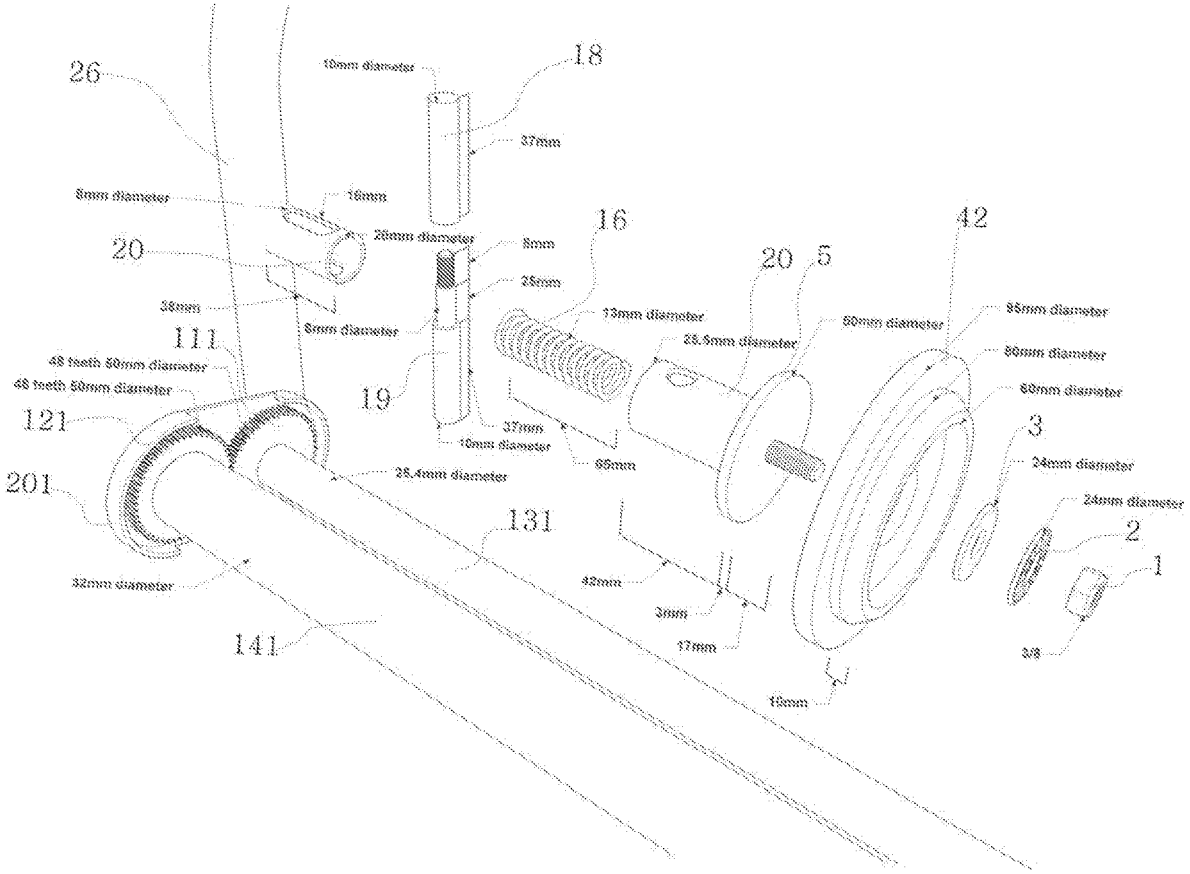
FIG. 5 illustrates an enlarged exploded view of left side of the portable membrane packing apparatus according to an aspect of the present invention.
Figure 6:
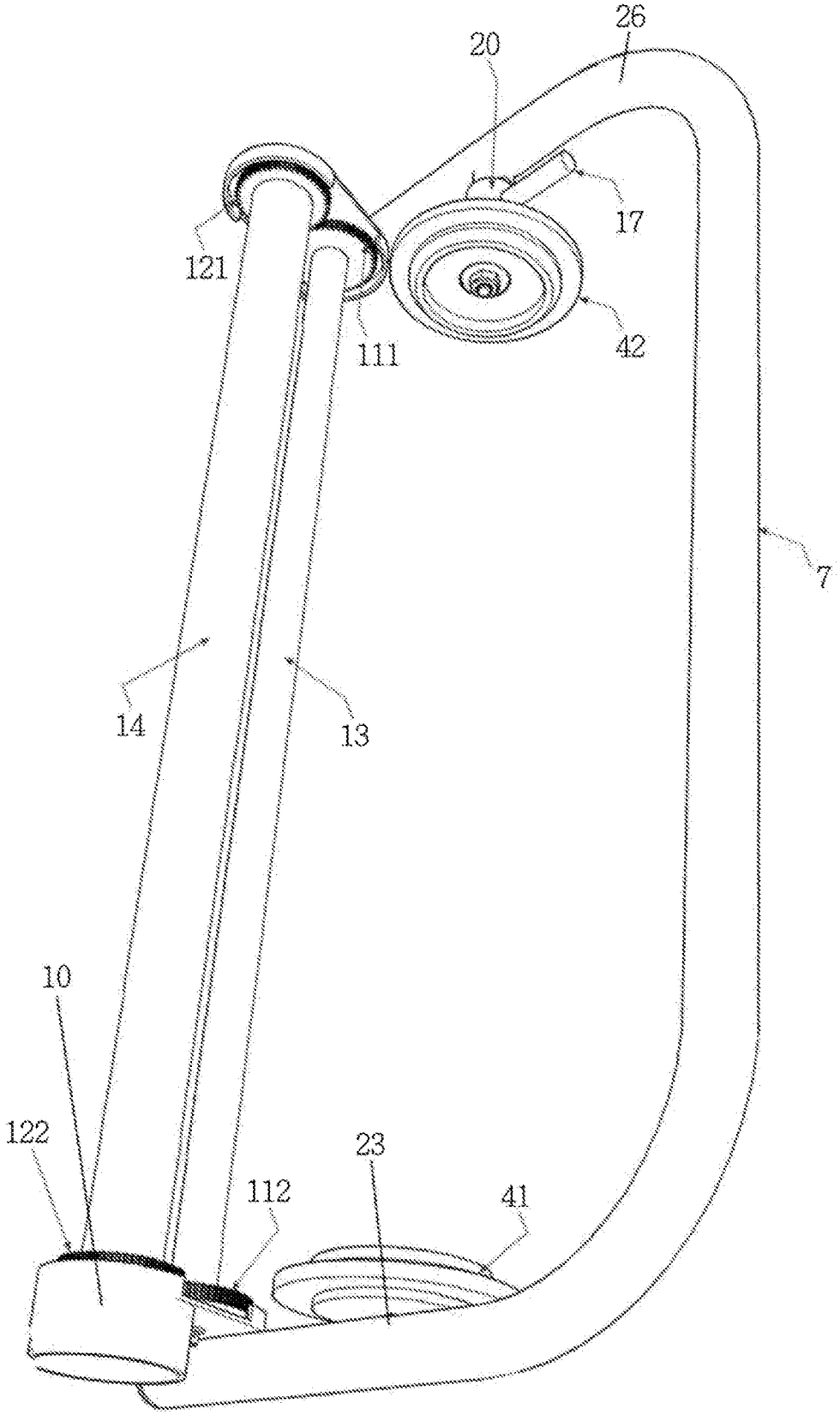
FIG. 6 illustrates an another view of the portable film packing apparatus according to an aspect of the present invention.
Figure 7:
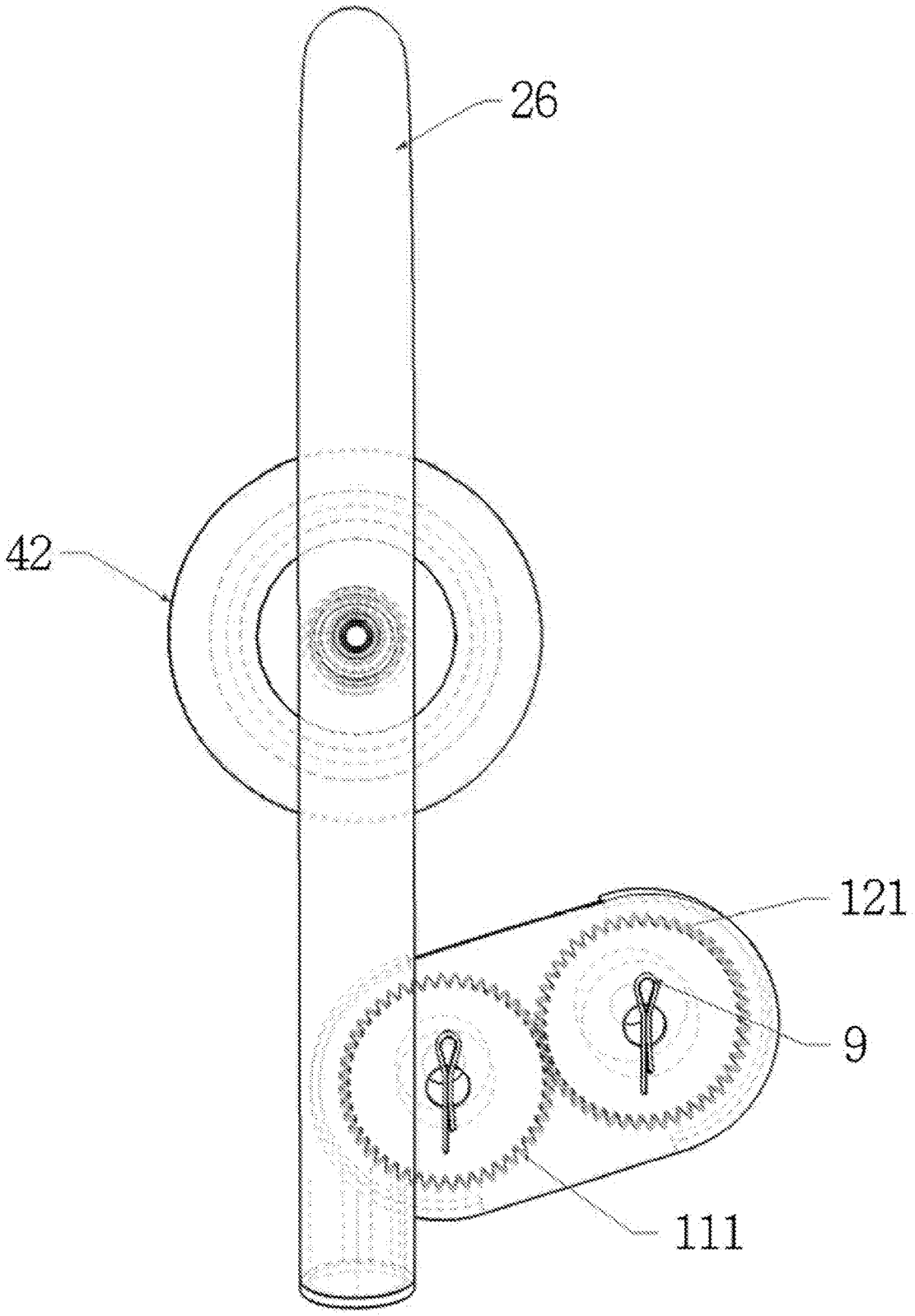
FIG. 7 illustrates a left side view of the portable film packing apparatus according to an aspect of the present invention.

As shown in FIGS. 4 and 5, according to an aspect of the present of the invention, a diameter of the first roller is 25.4 mm and a diameter of the second roller is 32 mm. However, the pair of first gears 111, 112 and the pair of second gears 121, 122 have the same number of teeth, 48 and the diameters 50 mm, respectively. However, it is understood that the diameters or sizes of the first roller and the second roller can be changed, respectively.

It may be understood that the diameter of second roller is longer than the diameter of the first roller by a range 25% to 35% for stretching the film tightly when packing.

When the film is passing between the first roller 131 and the second roller 141 because of a difference between the diameter of the first roller and the diameter of the second roller even though rotation speeds of the pairs of the first gears and the pairs of the second gears are the same, thereby increasing film tension and promoting stretching of the film for uniform wrapping with greater elasticity.

FIGS. 1 and 7-9 illustrate how to form an angle between the left and the right combining rods 23, 26 and the roller unit 300 and how to dispose a first roller unit 13 and a second roller unit 14 from the holding-and-drawing rod 7 according to an aspect of the present invention.

In order to keep stretching the film tightly and uniformly when using the film packing apparatus 100, the angle, between the left and the right combining rods 23, 26 and the roller unit 300, may be less than an acute angle is preferred according to an aspect of the present invention.

According to another aspect, specifically, the angle may be in a range of 60°-80°.

More specifically, the angle, around 70° may be preferred according to an aspect of the present invention.

Figure 8:
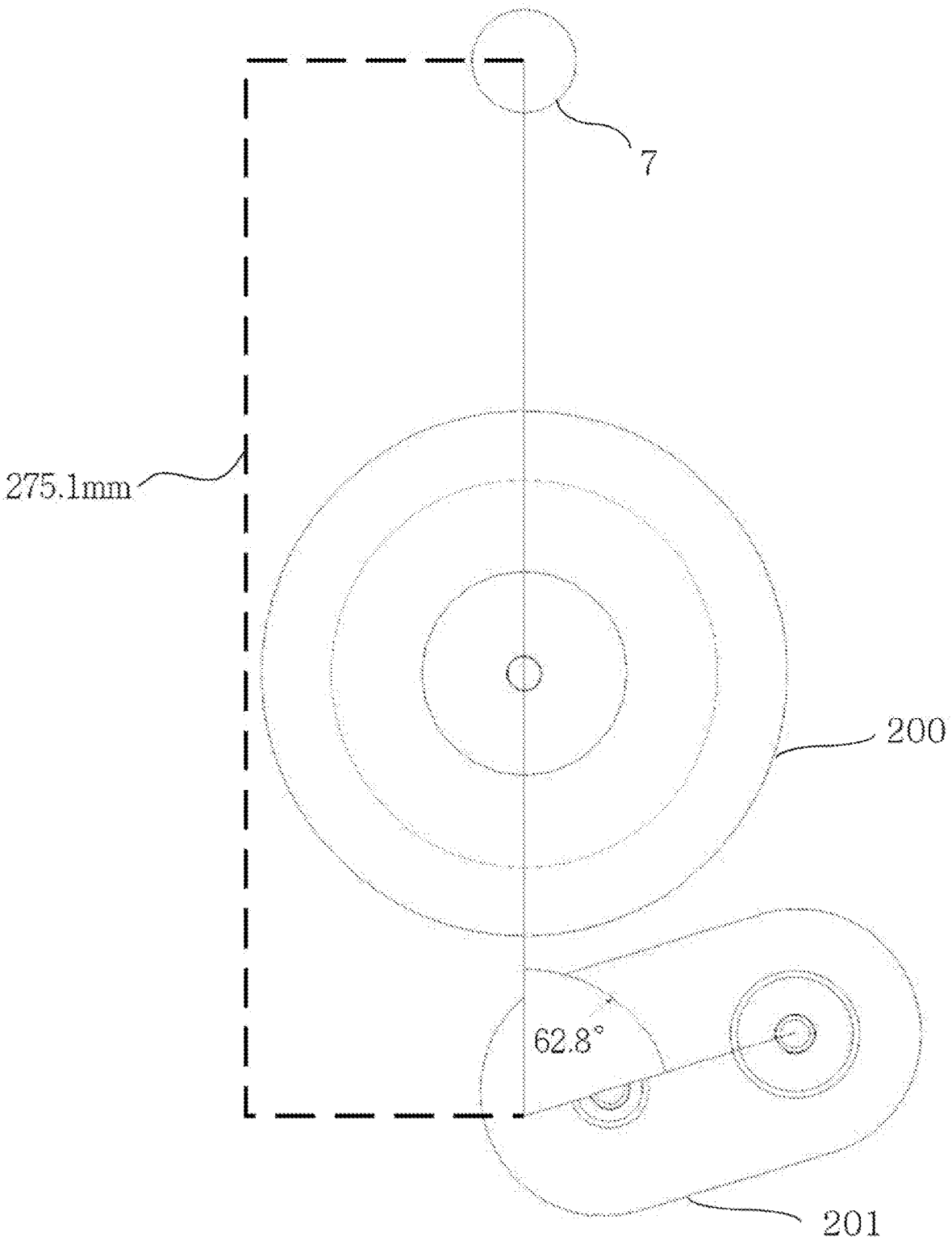
FIG. 8 illustrates how to form an angle between a holding-and-drawing rod and a roller unit according to an aspect of the present invention.
Figure 9:
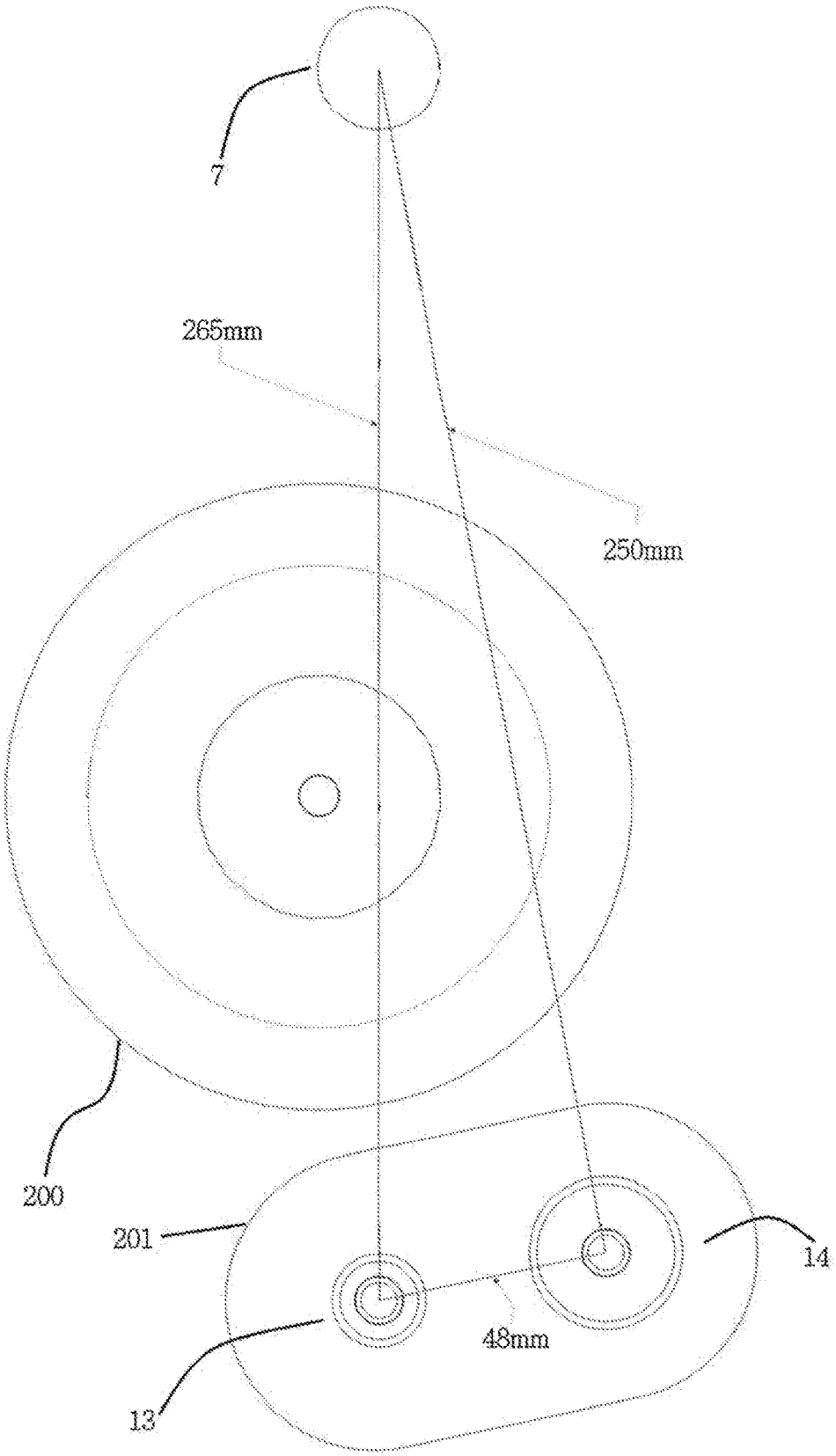
FIG. 9 illustrates how to dispose the first roller and the second roller, respectively, from the holding-and-drawing rod and the second roller according to an aspect of the present invention.

As shown in FIGS. 1, 8 and 9, by attaching roller unit 300, which includes a first roller unit 13, and the second roller unit 14, attached to the left and the right combining rods 23, 26 with an angle therebetween less than an acute angle, thereby a first predetermined distance between the holding-and-drawing rod 7 and the first roller unit 13 may be 265 mm and a second predetermined distance therebetween the hold-and-drawing rod 7 and the second roller unit 14 may be 250 mm according to an aspect of the present invention.

However, it is understood that the first and the second distances may be changed.

As shown in FIGS. 1-3 and 4-6, the portable film packing apparatus may further include a stand unit 10 of the portable film packing apparatus according to an aspect of the present invention.

As shown in FIG. 2, the stand unit 10 may be attached to the right roller fixing plate 202. However, the stand unit 10 may be disposed at a different position as long as the stand unit 10 can help to stand the portable film packing apparatus alone when not in use. In addition, a shape of the stand unit 10 may be a round, rectangular, or any other shape according to an aspect to the present invention.

At least a portion of the first combining rod 23 may be utilized to support the stand unit 10 for the portable film main packing body 100 to stand up when not in use according to an aspect of the present invention.

As can be understood from the above description, this invention has the following advantages.

The membrane reel holding unit of the film packing apparatus 100 can be easily moved by holding the membrane reel release unit; therefore, the membrane reel 200 can be loaded with or unloaded from the packing apparatus easily and quickly.

It is simple in structure and can be operated completely by hand to carry out packing, economizing more expense for both assembly and maintenance than a conventional electrical membrane-packing machine needs according to an aspect of the present invention.

It is small and light, convenient to be stored or carried about according to an aspect of the present invention.

It is light and easy to be held and moved around to carry out membrane packing quickly, needless to move a loading plank and articles piled thereon according to an aspect of the present invention.

It is easy to install the membrane reel on the packing apparatus and convenient to draw the membrane outward to carry out packing able to carry out membrane packing efficiently according to an aspect of the present invention.

The pair of rollers of the film packing apparatus having different diameter each other enable the membrane reel to produce proper rotation resistance and elastic tension to the film for packing convenience and economically according to an aspect of the present invention.

The membrane reel can be quickly loading or unloading from the packing apparatus, and the membrane reel can be drawn out for use smoothly, conforming to ergonomics in holding and handling of the packing apparatus according to an aspect of the present invention.

Although particular embodiments of the present invention have been described in detail for purposes of illustration, various modifications and enhancements may be made without departing from the spirit and scope of the present invention, it will be recognized and understood that various modifications may be made therein and the appended claims are intended to cover all such modifications that may fall within the spirit and scope of the invention.

What is claimed is:

1. A portable film packing apparatus, comprising:

a main body including a holding-and-drawing rod at a middle portion of the portable film packing apparatus main body, a first combining rod is at one end, and a second combining rod disposed at an other end of the portable film packing main body;

a first reel holding unit rotatably attached to the first combining rod;

a boss attached to the second combining rod, an elastic body disposed in a bore of the boss;

a membrane reel release unit movably attached to the boss;

an elastic body compression unit configured to compress the elastic body;

a second reel holding unit attached to the elastic body compression unit and faced with the first reel holding unit, and wherein the first reel holding unit and the second reel holding unit maintain a first predetermined distance while holding a membrane reel unit therebetween, wherein the first reel holding unit and the second reel holding unit becomes a predetermined second distance therebetween while pulling down the membrane reel release unit toward the second combining rod and the second reel holding unit moving away from the first reel holding unit to release the membrane reel unit, wherein the first predetermined distance is shorter than the second predetermined distance while pulling down the membrane reel release unit, and wherein the boss includes a pair of a membrane reel release unit limiting elongate grooves formed symmetrically on the boss, respectively, to receive the membrane reel release unit therethrough.

2. The portable film packing apparatus of claim 1, wherein the elastic body compression unit further includes a wall axially cut with two symmetrical membrane release unit insert holes for fixing the membrane reel release unit inserted therethrough.

3. The portable film packing apparatus of claim 1, wherein the elastic body is a spring.

4. The portable film packing apparatus of claim 1, wherein the first reel holding unit and the second reel holding are rotatably fastened by a bearing and a nut, respectively.

5. The portable film packing apparatus of claim 1, wherein the first reel holding unit and the second reel holding are rotatably fastened by a thrust bearing, a washer and a nut, respectively.

6. A portable film packing apparatus, comprising a main body including a holding-and-drawing rod at a middle portion of the portable film packing apparatus main body, a first combining rod is at one end, and a second combining rod disposed at an other end of the portable film packing main body;

a first reel holding unit rotatably attached to the first combining rod;

a boss attached to the second combining rod, an elastic body disposed in a bore of the boss;

a membrane reel release unit movably attached to the boss;

an elastic body compression unit configured to compress the elastic body;

a second reel holding unit attached to the elastic body compression unit and faced with the first reel holding unit, and wherein the first reel holding unit and the second reel holding unit maintain a first predetermined distance while holding a membrane reel unit therebetween, wherein the first reel holding unit and the second reel holding unit becomes a predetermined second distance therebetween while pulling down the membrane reel release unit toward the second combining rod and the second reel holding unit moving away from the first reel holding unit to release the membrane reel unit, wherein the first predetermined distance is shorter than the second predetermined distance while pulling down the membrane reel release unit, and wherein the elastic body compression unit includes two ends, one end is a closed end formed with a small-diameter bolt head to be inserted through a reel holding unit hole of the second reel holding unit and screwed with a nut to fix the elastic body with the second reel holding unit and the other end bored with a hollow end to receive the elastic body.

7. The portable film packing apparatus of claim 6, wherein the elastic body compression unit further includes a wall axially cut with two symmetrical membrane release unit insert holes for fixing the membrane reel release unit inserted therethrough.

8. The portable film packing apparatus of claim 6, wherein the elastic body is a spring.

9. The portable film packing apparatus of claim 6, wherein the first reel holding unit and the second reel holding are rotatably fastened by a bearing and a nut, respectively.

10. A portable film packing apparatus, comprising a main body including a holding-and-drawing rod at a middle portion of the portable film packing apparatus main body, a first combining rod is at one end, and a second combining rod disposed at an other end of the portable film packing main body;

a first reel holding unit rotatably attached to the first combining rod;

a boss attached to the second combining rod, an elastic body disposed in a bore of the boss;

a membrane reel release unit movably attached to the boss;

an elastic body compression unit configured to compress the elastic body;

a second reel holding unit attached to the elastic body compression unit and faced with the first reel holding unit, and wherein the first reel holding unit and the second reel holding unit maintain a first predetermined distance while holding a membrane reel unit therebetween, wherein the first reel holding unit and the second reel holding unit becomes a predetermined second distance therebetween while pulling down the membrane reel release unit toward the second combining rod and the second reel holding unit moving away from the first reel holding unit to release the membrane reel unit, wherein the first predetermined distance is shorter than the second predetermined distance while pulling down the membrane reel release unit, and wherein the membrane reel release unit is a cylindrically shaped bar.

11. The portable film packing apparatus of claim 10, wherein the elastic body compression unit further includes a wall axially cut with two symmetrical membrane release unit insert holes for fixing the membrane reel release unit inserted therethrough.

12. The portable film packing apparatus of claim 10, wherein the elastic body is a spring.

13. The portable film packing apparatus of claim 10, wherein the first reel holding unit and the second reel holding are rotatably fastened by a bearing and a nut, respectively.

* * * * *